US007623094B2

(12) United States Patent
Chen et al.

(10) Patent No.: US 7,623,094 B2
(45) Date of Patent: Nov. 24, 2009

(54) DRIVING CIRCUIT FOR PLASMA DISPLAY PANEL

(75) Inventors: Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 763 days.

(21) Appl. No.: 11/425,387

(22) Filed: Jun. 20, 2006

(65) Prior Publication Data

US 2006/0290603 A1 Dec. 28, 2006

Related U.S. Application Data

(60) Provisional application No. 60/595,308, filed on Jun. 22, 2005.

(51) Int. Cl.
*G09G 3/28* (2006.01)

(52) U.S. Cl. ..... 345/66; 345/63

(58) Field of Classification Search ..... 345/60, 345/63, 66, 76, 204, 211, 212; 313/567; 315/169.3, 169.4
See application file for complete search history.

(56) References Cited

U.S. PATENT DOCUMENTS 7,391,415 B2 * 6/2008 Lee et al. ..... 345/211
7,479,952 B2 * 1/2009 Lee et al. ..... 345/204
7,528,800 B2 * 5/2009 An et al. ..... 345/60

FOREIGN PATENT DOCUMENTS

CN 1622163 A 6/2005

* cited by examiner

*Primary Examiner*—Ricardo L Osorio
(74) *Attorney, Agent, or Firm*—Winston Hsu

(57) ABSTRACT

A driving circuit for the sustain waveforms of plasma display panel (PDP) includes voltage clamping and energy recovery. The PDP functions as an equivalent capacitor having X and Y sides. A Scan IC has a transistor QH coupled between a first terminal of the Scan IC and the Y side and a transistor QL coupled between a second terminal of the Scan IC and the Y side. The first terminal of the Scan IC is coupled with a first voltage source. A first switch is coupled to coupled to the second terminal of the Scan IC, a second switch is coupled between a second voltage source and the X side, and a third switch is coupled with both the X side and a fourth switch. The fourth switch is also coupled to the second terminal of the Scan IC and serially to an inductor, a fifth switch, and ground.

16 Claims, 17 Drawing Sheets

DRIVING CIRCUIT FOR PLASMA DISPLAY PANEL

CROSS REFERENCE TO RELATED APPLICATIONS

The present application claims the benefit of priority from U.S. Provisional Patent Application No. 60/595,308, filed on Jun. 22, 2005, which is hereby incorporated by reference as if set forth in full in this document for all purposes.

BACKGROUND OF THE INVENTION

1. Field of the Invention

The present invention relates to a driving circuit, and more particular, to a driving circuit for plasma display panel (PDP).

2. Description of the Prior Art

FIG. 1 is a prior art driving circuit 100 of a plasma display panel. An equivalent capacitor of the PDP is marked as Cpanel. There are switches S1, S3, and an energy recovery circuit 110 coupled to the X-side of panel. S1 is coupled to a voltage source V1 and S3 is coupled to ground. The energy recover circuit 110 comprises a switch S5 and a diode D5 in series coupled in parallel with serially coupled switch S6 and a diode D6. The two parallel circuits are coupled between an inductor L1 (L1 couples with the X-side of the panel) and a capacitor C1 for energy recovery, which is also coupled to ground.

Similarly, coupled to the Y-side of the panel are switches S2, S4, and an energy recovery circuit 120. S5, S6, S7 and S8 are switches. S2 is coupled to a voltage source V2 and S4 is coupled to ground. The energy recover circuit 120 comprises a switch S7 and a diode D7 in series coupled in parallel with serially coupled switch S8 and a diode D8. The two parallel circuits are coupled between an inductor L2 (L2 couples with the Y-side of the panel) and a capacitor C2 for energy recovery, which is also coupled to ground.

The X-side circuit and the Y-side circuit together form the capacitor Cpanel. Details of exact functioning of the driving circuit 100 are well known in the art and will be omitted here for brevity. However, it is important to notice that the driving circuit 100 requires quite a few components, making it expensive to make. Cost conscious consumers desiring a PDP demand lower prices and thus make PDPs comprising similar circuits uncompetitive in today's market.

SUMMARY OF THE INVENTION

It is therefore an objective of the claimed invention to provide a driving circuit for a PDP having fewer components, at a reduced cost.

A driving circuit for a plasma display panel according to the claimed invention includes a plasma display panel acting as an equivalent capacitor having X and Y sides. A Scan IC has a transistor QH coupled between a first terminal of the Scan IC and the Y side and a transistor QL coupled between a second terminal of the Scan IC and the Y side. The first terminal of the Scan IC is coupled with a first voltage source. A first switch is coupled to the second terminal of the Scan IC, a second switch is coupled between a second voltage source and the X side, and a third switch is coupled with both the X side and a fourth switch. The fourth switch is also coupled to the second terminal of the Scan IC and serially to an inductor, a fifth switch, and ground.

Another driving circuit for a plasma display panel according to the claimed invention includes a plasma display panel acting as an equivalent capacitor having X and Y sides, with the X side coupled directly to ground. A Scan IC has a transistor QH coupled between a first terminal of the Scan IC and the Y side and a transistor QL coupled between a second terminal of the Scan IC and the Y side. The first terminal of the Scan IC is coupled with a first voltage source. A first switch is coupled between a second voltage source and the second terminal of the Scan IC and a second switch is coupled to ground and serially coupled with an inductor and the second terminal of the Scan IC.

The advantage of the claimed invention is that the necessary driving waveforms can be generated using the claimed circuit at a reduced cost.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
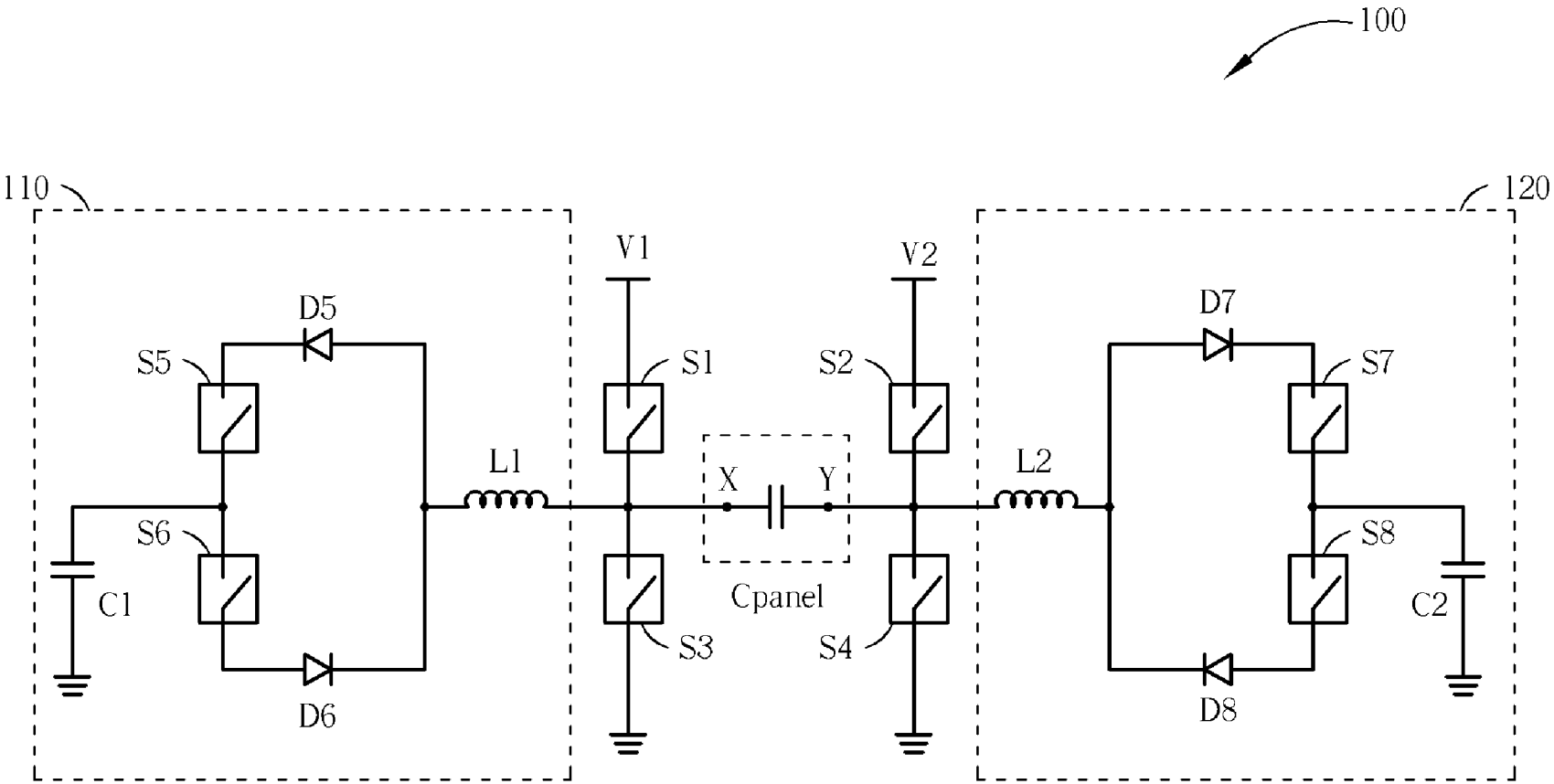
Fig. 1 Prior art
FIG. 1 is a driving circuit for a PDP according to prior art.
Figure 2:
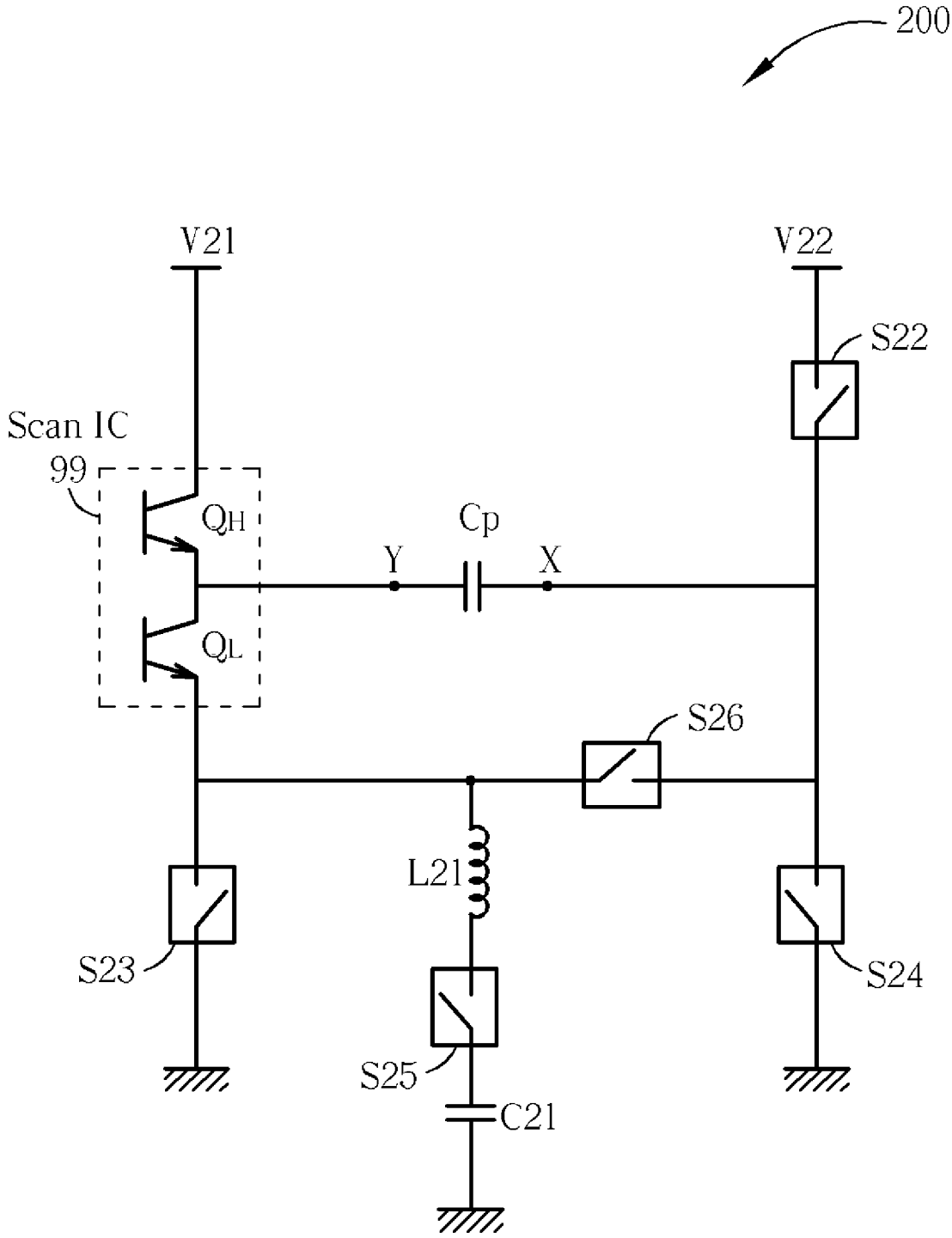
FIG. 2 is a driving circuit for a PDP according to the present invention.

Please refer to FIG. 2 that is a driving circuit 200 for a PDP according to the present invention that comprises switches S22, S23, S24, S25, and S26, a Scan IC 99, an inductor L21, a capacitor C21, and a capacitor Cp having X and Y sides that is the equivalent capacitor formed by the PDP.

A first voltage source V21 is coupled with a first terminal of the Scan IC 99. The switch S23 is coupled between ground and a second terminal of the Scan IC 99. The Scan IC 99 comprises a transistor QH coupled between the first terminal of the Scan IC and the Y side and a transistor QL coupled between the second terminal of the Scan IC and the Y side. The switch S22 is coupled between a second voltage source V22 and the X side. The switch S24 is coupled between ground and both the X side and the switch S26. The switch S26 is also coupled to the second terminal of the Scan IC 99 and to one end of the inductor L21. The other end of the inductor L21 couples with the switch S25, the capacitor C21, and ground in series. Voltage sources V21 and V22 can be the same or different.

Figure 3:
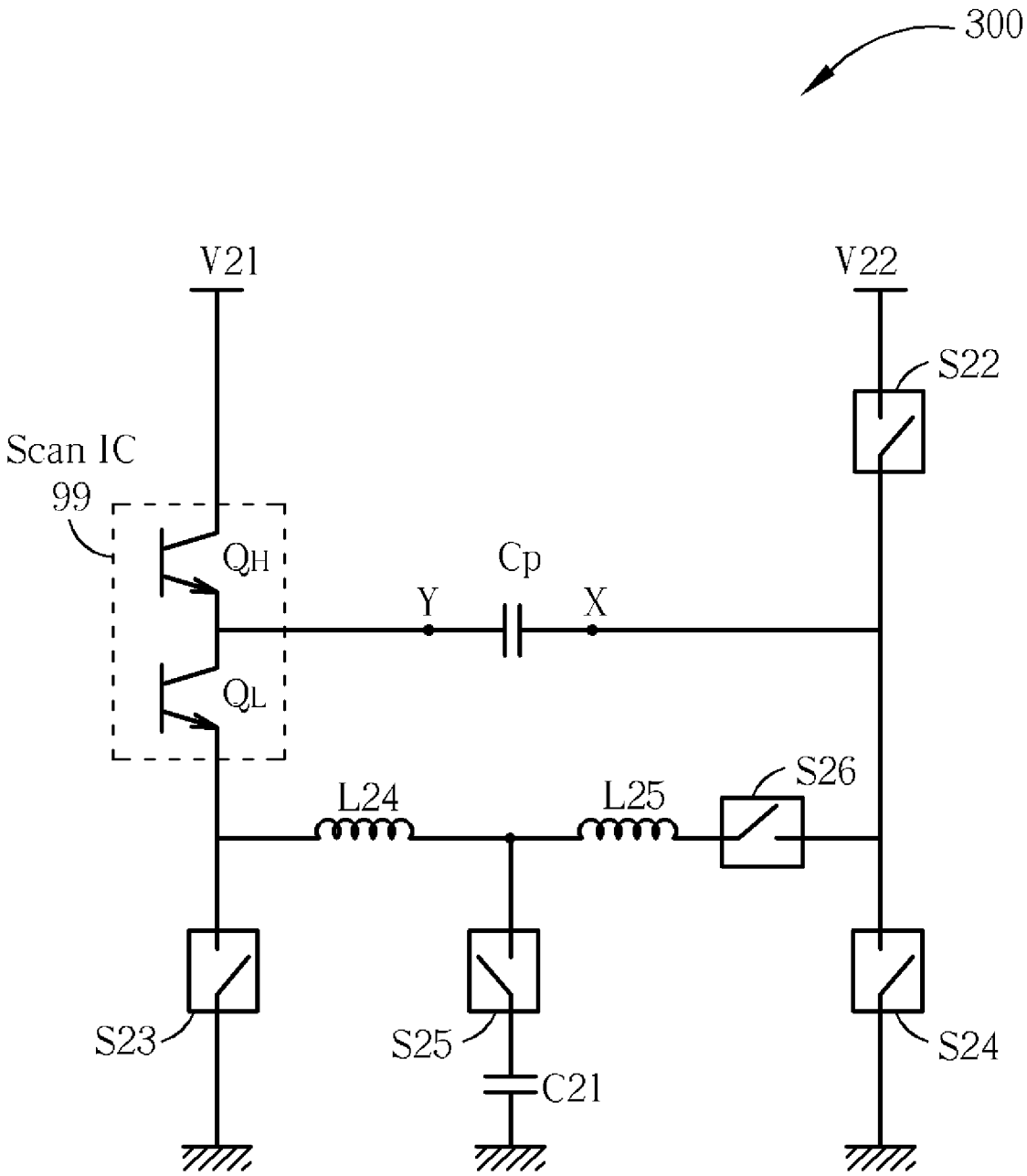
FIG. 3 is one embodiment of the driving circuit of FIG. 2.

FIG. 3 is another driving circuit 300 that is one embodiment of the driving circuit 200 of FIG. 2. Connections and functionalities of all like numbered elements are the same as in FIG. 2, except that the inductor L21 of FIG. 2 has been replaced with inductors L24 and L25. As is illustrated in FIG. 3, the inductor L25 is coupled between the switch S26 and the switch S25, and the inductor L24 is coupled between the switch S25 and the second terminal of the Scan IC 99. The slopes of rising and falling of sustain waveforms can be adjusted by these inductors.

Figure 4:
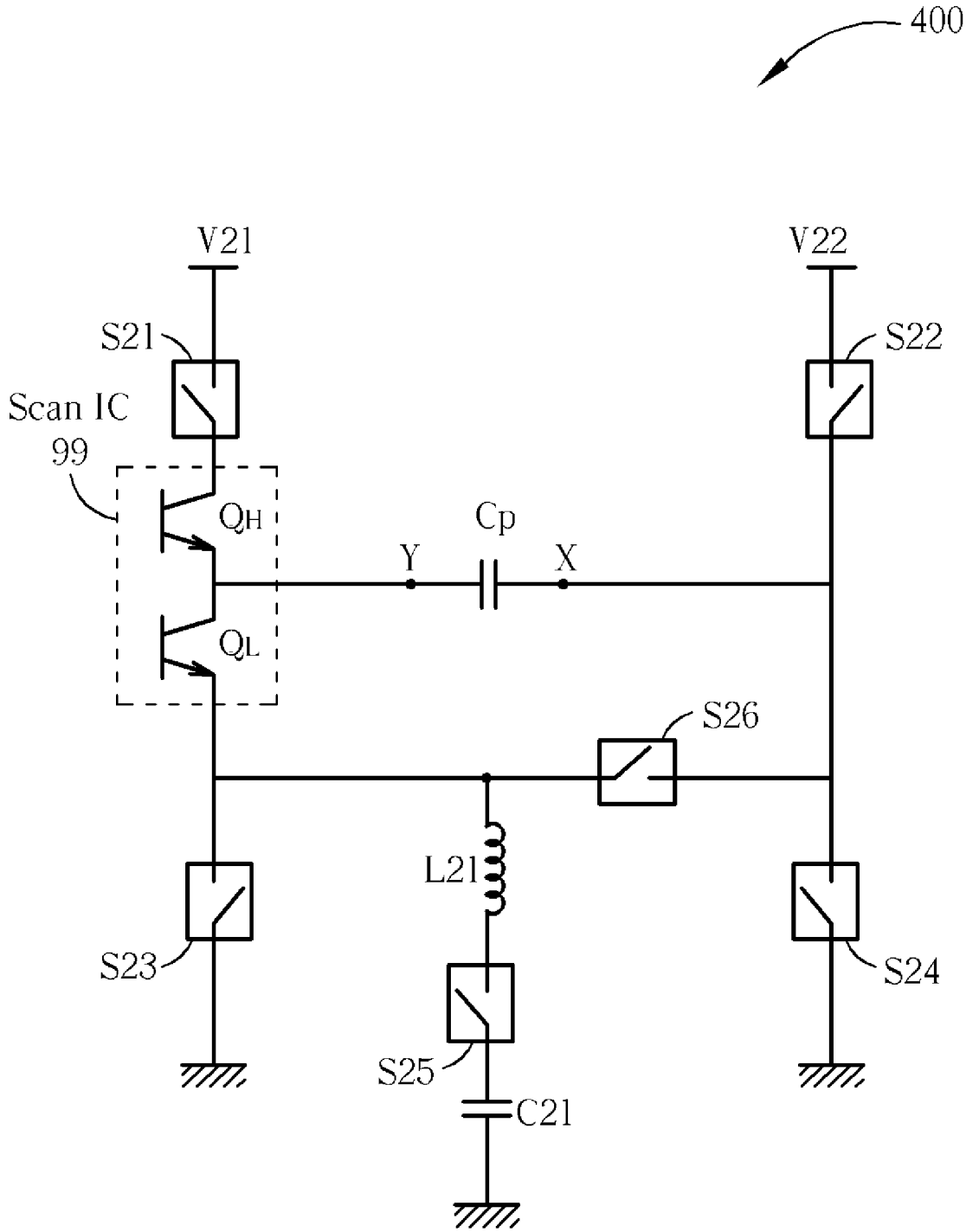
FIG. 4 is another embodiment of the driving circuit of FIG. 2.

FIG. 4 is another driving circuit 400 that is a modified version of the PDP driving circuit 200 in FIG. 2. Connections and functionalities of all like numbered elements are the same as in FIG. 2. The difference between the driving circuit 200 and the driving circuit 400 is that the driving circuit 400 further includes a switch S21 coupled between the first voltage source V21 and the first terminal of the Scan IC 99.

Figure 5:
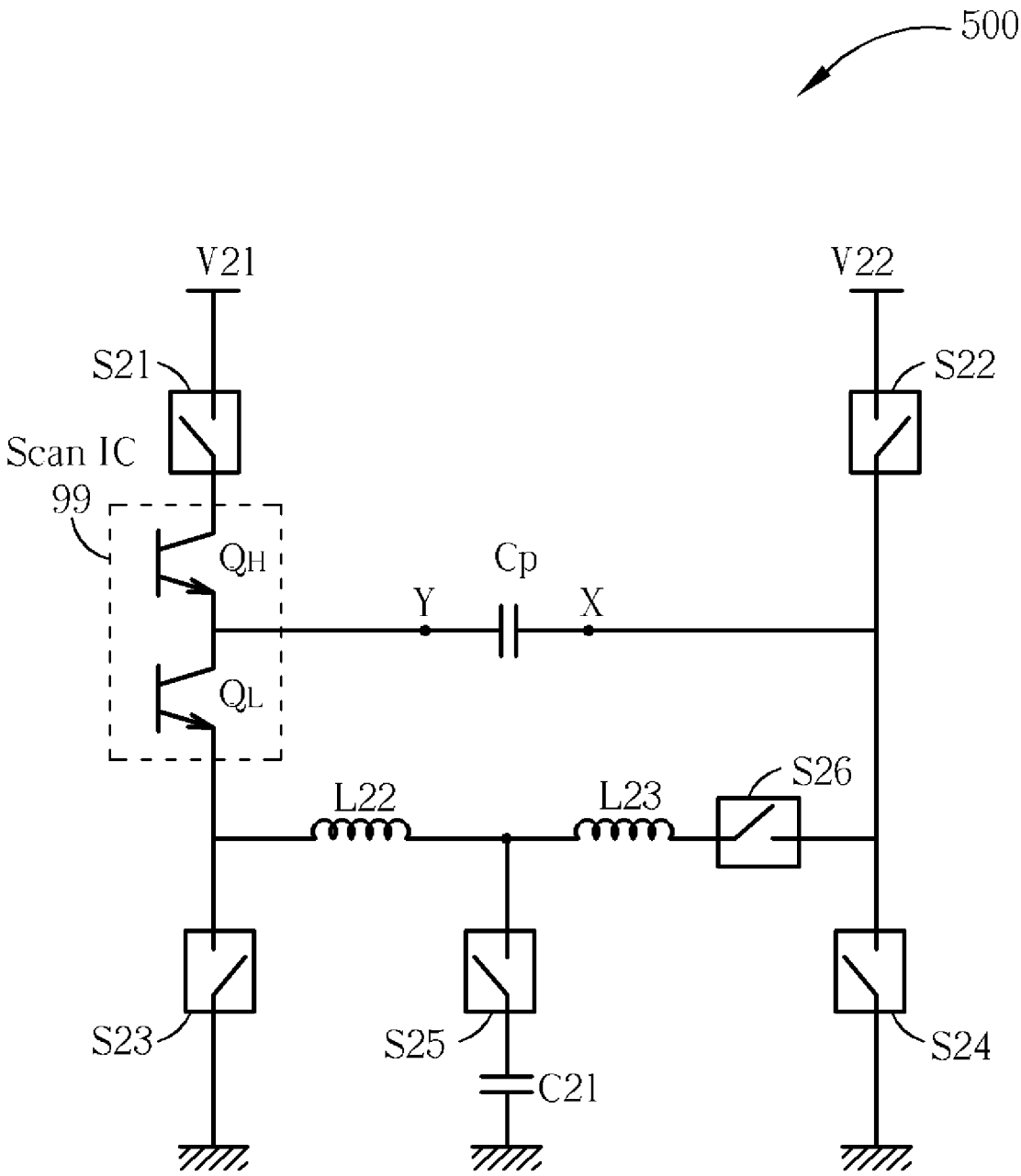
FIG. 5 is one embodiment of the driving circuit of FIG. 4.

Please refer now to FIG. 5 that illustrates a driving circuit 500, which is a variation of the circuit 400 shown in FIG. 4. In FIG. 5, connections and functionalities of all like numbered elements are the same as in FIG. 4, except that the inductor L21 of FIG. 4 has been replaced with inductors L22 and L23. As is illustrated in FIG. 5, the inductor L23 is coupled between the switch S26 and the switch S25, and the inductor L22 is coupled between the switch S25 and the second terminal of the Scan IC 99.

Figure 6:
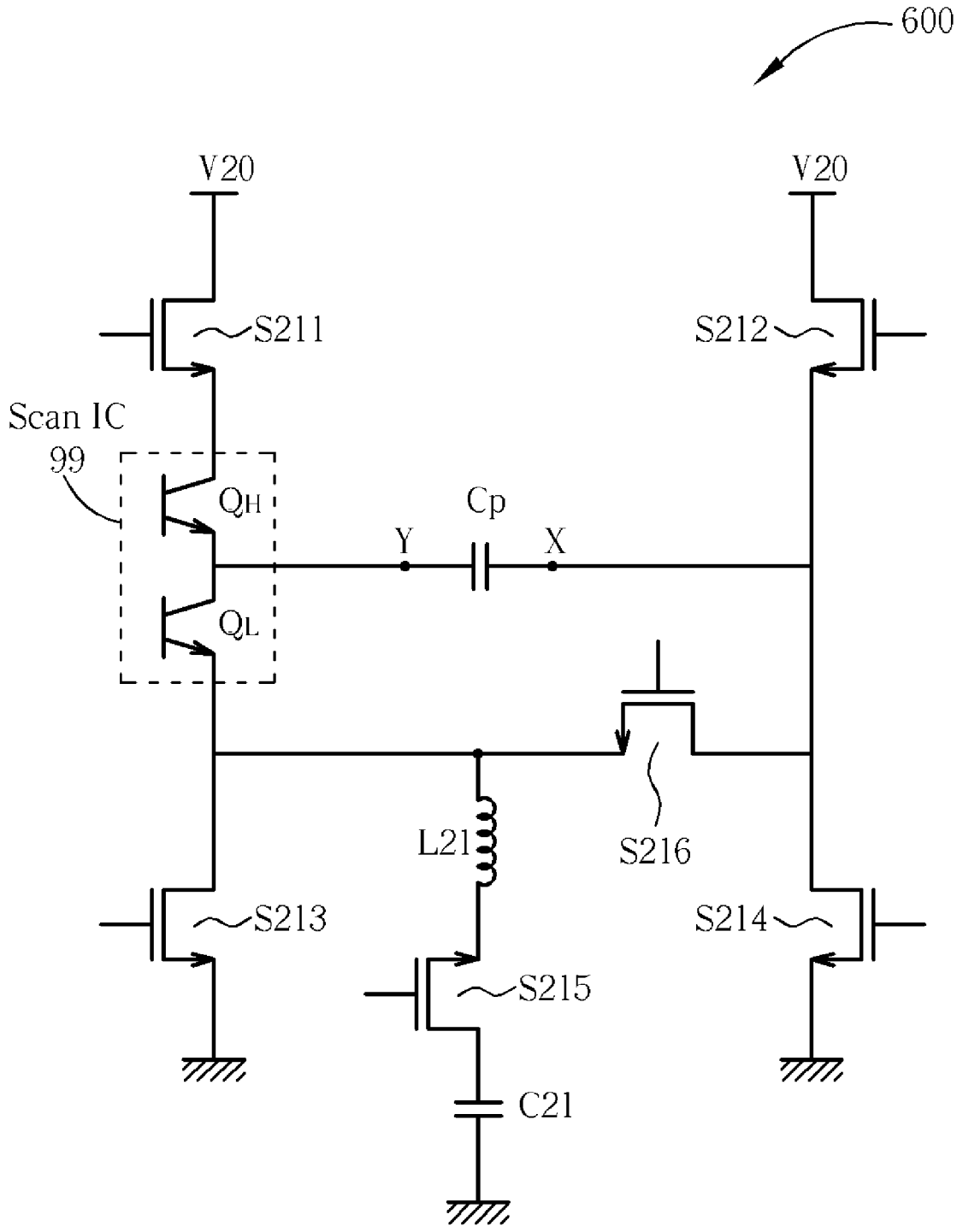
FIG. 6 is another embodiment of the driving circuit of FIG. 4.
Figure 15:
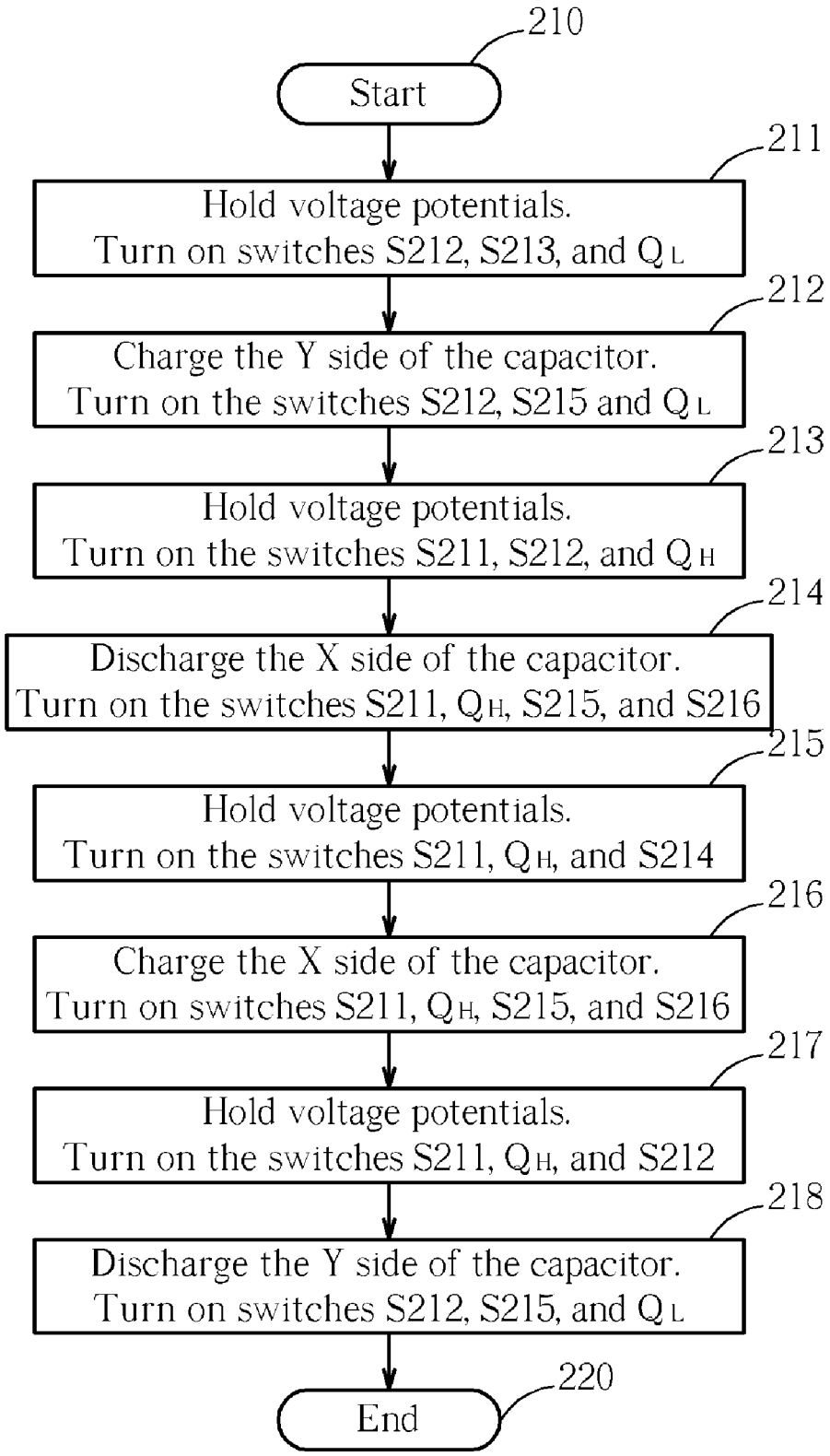
FIG. 15 is a flow chart of creating a sustain waveform in the driving circuit of FIG. 6.

FIG. 6 is another driving circuit 600 that is a modified version of the PDP driving circuit 400 in FIG. 4 with the connections and functionalities of all like numbered elements the same as in FIG. 4. The difference between the driving circuit 400 and the driving circuit 600 is that the driving circuit 600 replaces all of the switches S21, S22, S23, S24, S25, and S26 with n-channel MOSFETs that are labeled S211, S212, S213, S214, S21 5, and S216 respectively. Here, the voltage sources V21 and V22 in the driving circuit 400 have the same voltage potential and are marked as V20 to indicate the situation. According to the FIG. 6, the operation for the sustain waveform is as following steps and according to the flow chart in FIG. 15. During all steps, switches not indicated as being turning on are assumed to be turned off by default. Obviously, the following steps can be repeated as desired.

Step 210: Start.

Step 211: Keep the voltage potential at the X side of the capacitor Cp at V20 by turning on the switch S212. Keep the Y side of the capacitor Cp at ground by turning on the switches S213 and QL of the Scan IC.

Step 212: Keep the voltage potential at the X side of the capacitor Cp at V20 by turning on the switch S212. Charge the Y side of the capacitor Cp by turning on the switches S215 and QL of the Scan IC. The voltage potential at Y side of the capacitor Cp goes up to V20 through the components S215, QL of the Scan IC, L21 and C21.

Step 213: Keep the voltage potential at the X side of the capacitor Cp at V20 by turning on the switch S212. Keep the voltage potential at the Y side of the capacitor Cp at V20 by turning on the switches S211 and QH of the Scan IC;

Step 214: Keep the voltage potential at the Y side of the capacitor Cp at V20 by turning on the switch S211 and QH of the Scan IC. Discharge the X side of the capacitor Cp by turning on the switches S215 and S216. The voltage potential at X side of the capacitor Cp goes down to ground through the components S215, S216, L21 and C21.

Step 215: Keep the voltage potential at the Y side of the capacitor Cp at V20 by turning on the switch S211 and QH of the Scan IC. Keep the voltage potential at the X side of the capacitor Cp at ground by turning on the switch S214.

Step 216: Keep the voltage potential at the Y side of the capacitor Cp at V20 by turning on the switch S211 and QH of the Scan IC. Charge the X side of the capacitor Cp by turning on the switches S215 and S216. The voltage potential at X side of the capacitor Cp goes up to V20 through the components S215, S216, L21 and C21.

Step 217: Keep the voltage potential at the Y side of the capacitor Cp at V20 by turning on the switch S211 and QH of the Scan IC. Keep the voltage potential at the X side of the capacitor Cp at V20 by turning on the switch S212.

Step 218: Keep the voltage potential at the X side of the capacitor Cp at V20 by turning on the switch S212. Discharge the Y side of the capacitor Cp by turning on the switches S215 and QL of the Scan IC. The voltage potential at Y side of the capacitor Cp goes down to ground through the components S215, QL of the Scan IC, L21 and C21.

Step 220: End.

Figure 7:
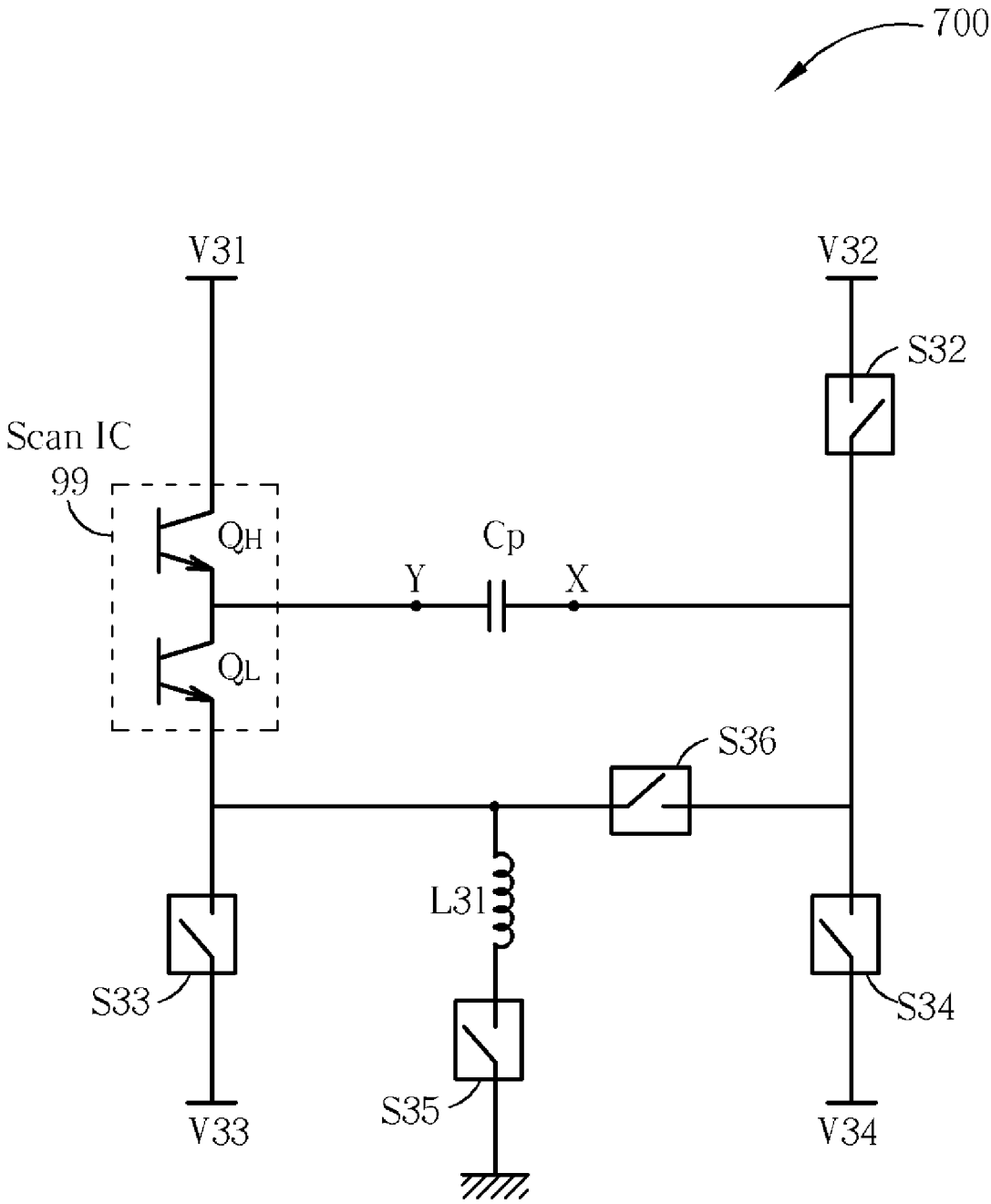
FIG. 7 is another driving circuit for a PDP according to the present invention.

FIG. 7 is a second major embodiment of a driving circuit 700 for a PDP according to the present invention that comprises switches S32, S33, S34, S35, and S36, a Scan IC 99, an inductor L31, and a capacitor Cp having X and Y sides that is the equivalent capacitor formed by the PDP.

A first voltage source V31 is coupled to a first terminal of the Scan IC 99. The switch S32 is coupled between a second voltage source V32 and the X side. The switch S33 is coupled between a second terminal of the Scan IC 99 and a third voltage source V33. The switch S34 is coupled between a fourth voltage source V34 and both the X side and the switch S36. The switch S36 is also coupled to the second terminal of the scan IC 99 and to one end of the inductor L31. The other end of the inductor L31 couples with the switch S35 and ground in series. The Scan IC 99 comprises a transistor QH coupled between the first terminal of the Scan IC 99 and the Y side and a transistor QL coupled between the second terminal of the Scan IC 99 and the Y side. Voltage sources V31 and V32 are positive voltage sources and V33 and V34 are negative voltage sources. V31 and V32 can be the same or different. V33 and V34 can be the same or different.

The major differences between the driving circuit 200 shown in FIG. 2 and the driving circuit 700 shown in FIG. 7 are that the capacitor C21 in FIG. 2 has been removed and the switches S33 and S34 (S23 and S24 in FIG. 2) are now connected to voltage sources V33 and V34 instead of ground.

Figure 8:
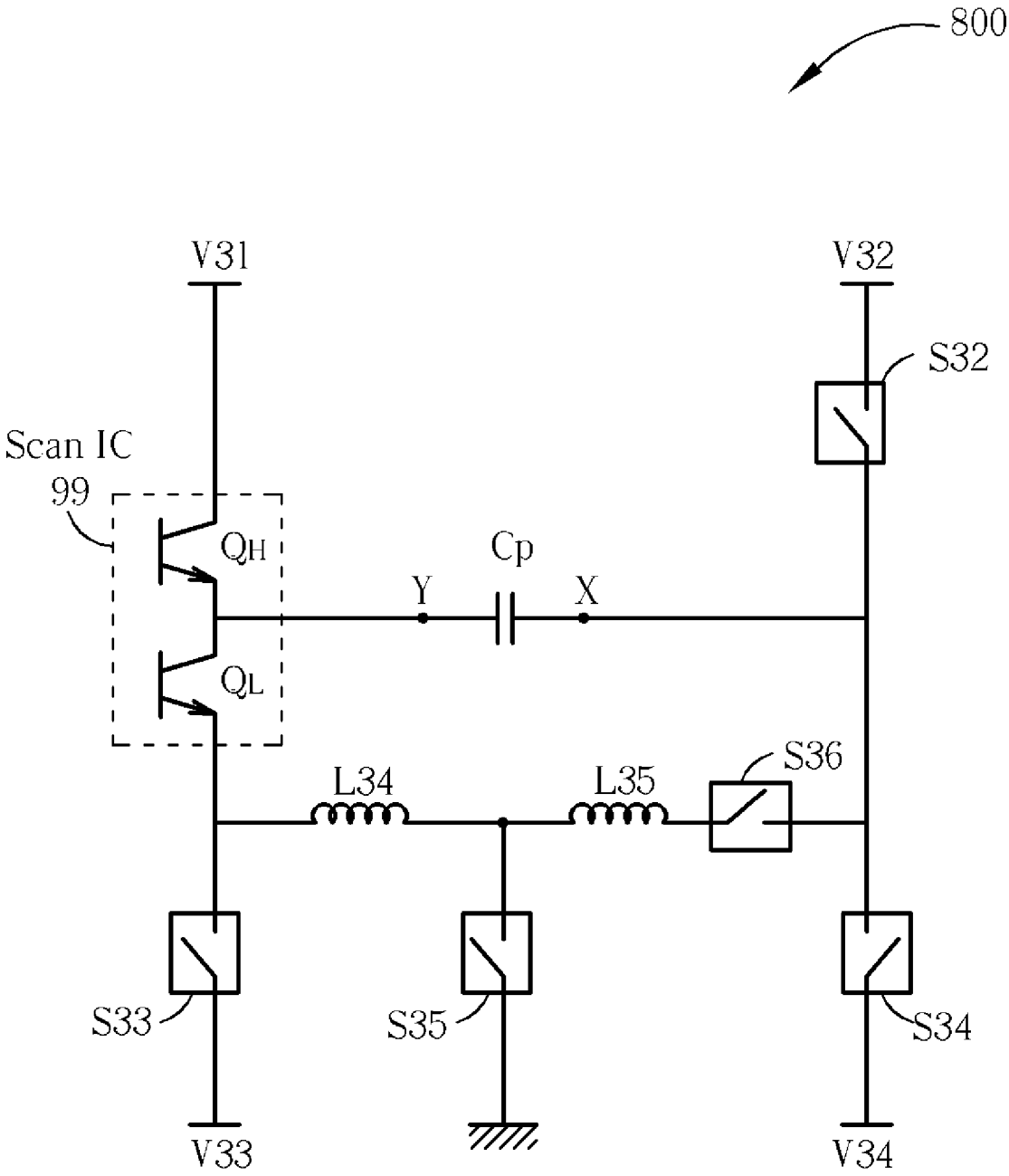
FIG. 8 is one embodiment of the driving circuit of FIG. 7.

FIG. 8 is a driving circuit 800 that is one embodiment of the driving circuit 700 of FIG. 7. Connections and functionalities of all like numbered elements are the same as in FIG. 7, except that the inductor L31 of FIG. 7 has been replaced with inductors L34 and L35. As is illustrated in FIG. 8, the inductor L35 is coupled between the switch S36 and the switch S35, and the inductor L34 is coupled between the switch S25 and the second terminal of the Scan IC 99.

Figure 9:
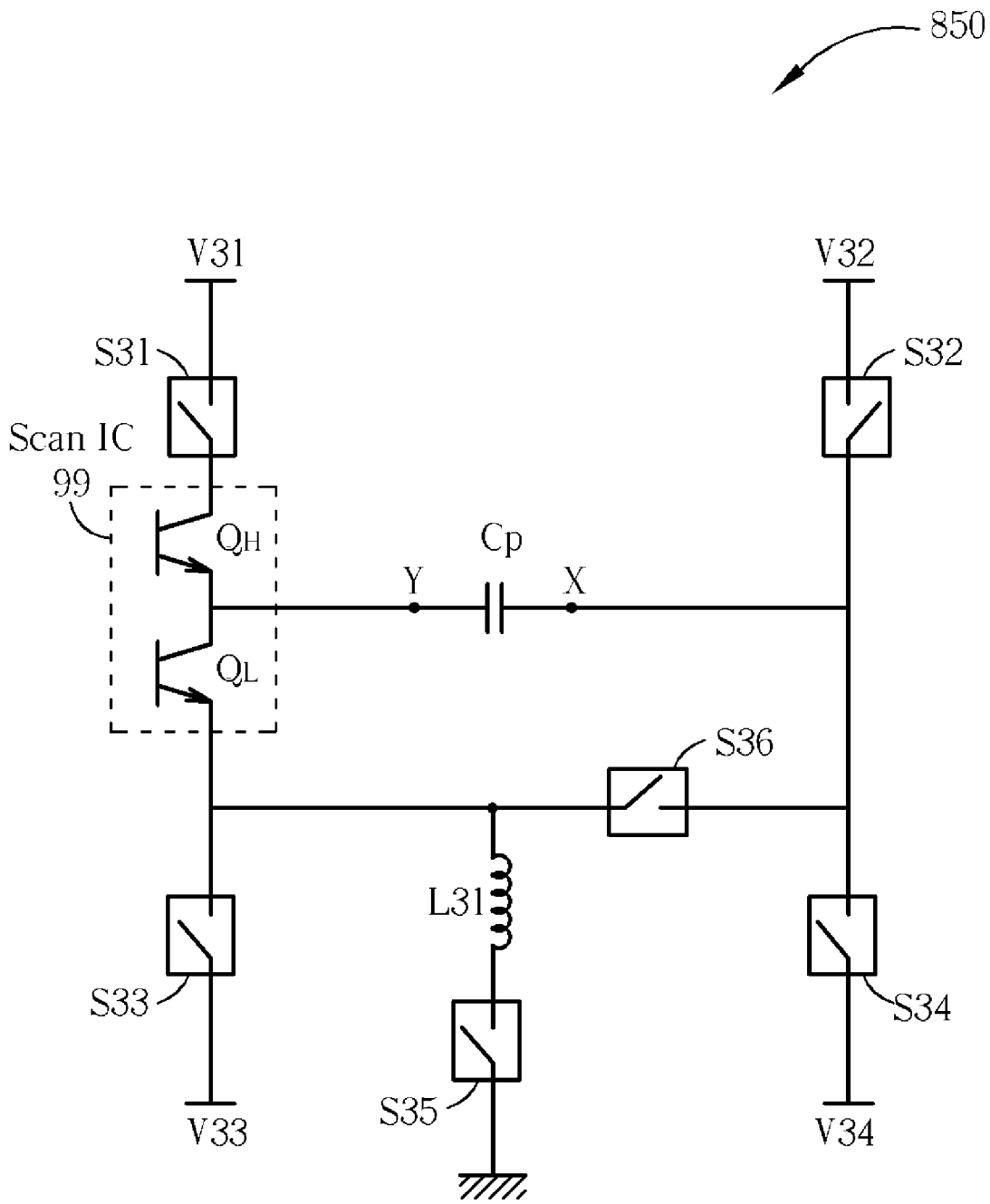
FIG. 9 is another embodiment of the driving circuit of FIG. 7.

FIG. 9 is a driving circuit 850 that is a modified version of the PDP driving circuit 700 in FIG. 7. Connections and functionalities of all like numbered elements are the same as in FIG. 7, The difference between the driving circuit 700 and the driving circuit 850 is that the driving circuit 850 further comprises a switch S31 coupled between the first voltage source V31 and the first terminal of the Scan IC 99.

Figure 10:
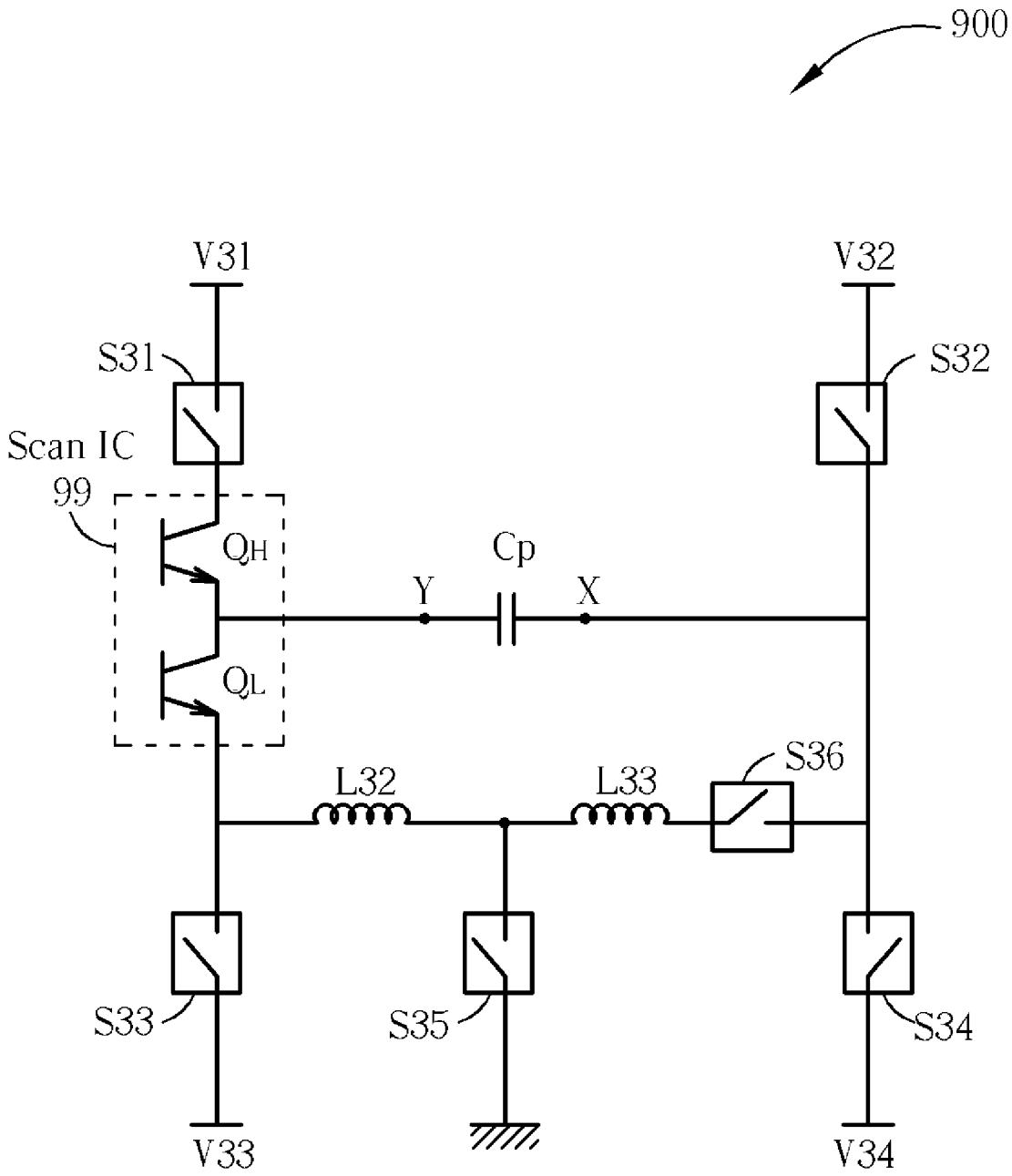
FIG. 10 is one embodiment of the driving circuit of FIG. 9.

Please refer now to the driving circuit 900 shown in FIG. 10, which is an additional variation of the driving circuit 850 shown in FIG. 9. In FIG. 10, connections and functionalities of all like numbered elements are the same as in FIG. 9, except that the inductor L31 of FIG. 9 has been replaced with inductors L32 and L33. The inductor L33 is coupled between the switch S36 and the switch S35 and the inductor L32 is coupled between the switch S35 and the second terminal of the Scan IC 99.

Figure 11:
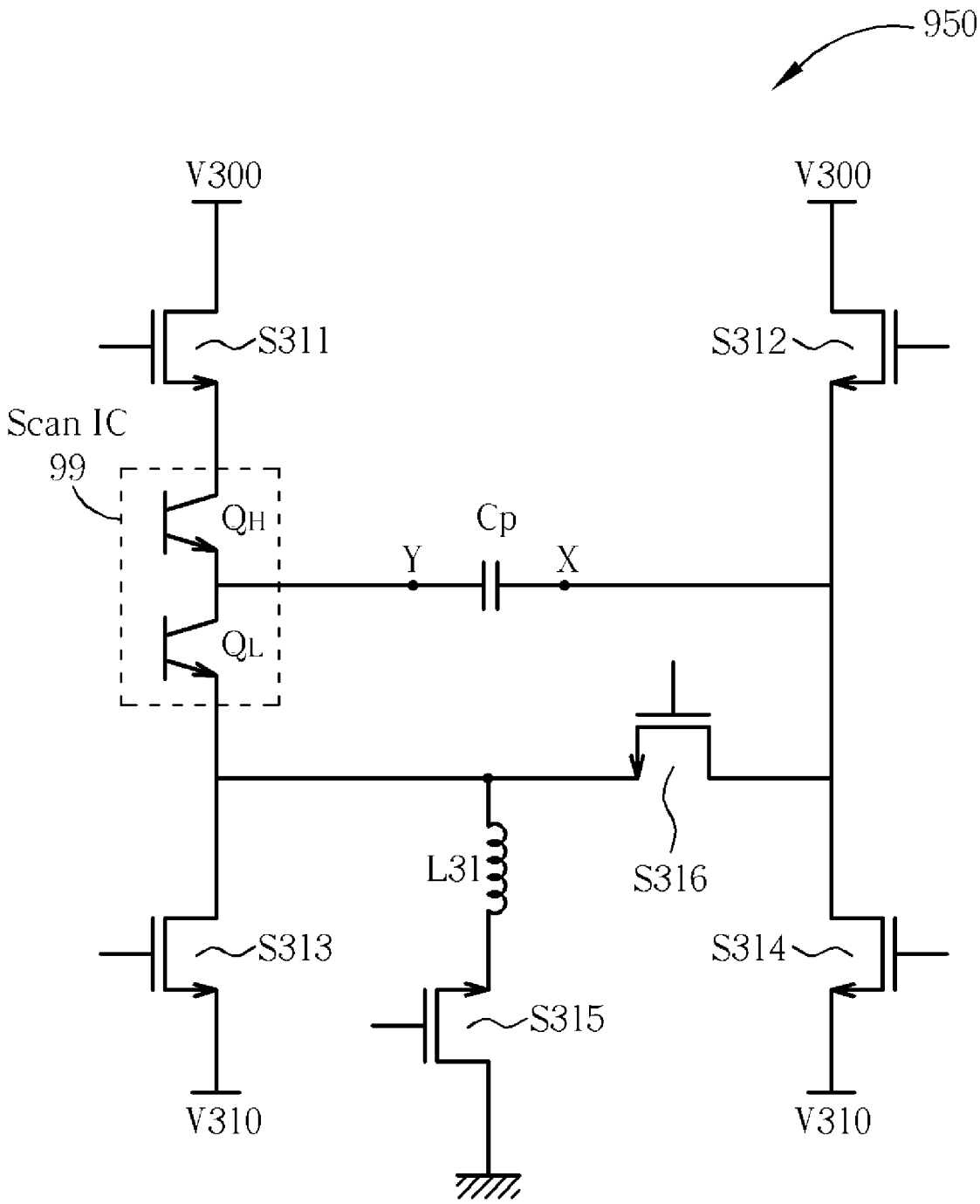
FIG. 11 is another embodiment of the driving circuit of FIG. 9.

FIG. 11 is a driving circuit 950 that is another modified version of the PDP driving circuit 850 in FIG. 9. Connections and functionalities of all like numbered elements are the same as in FIG. 9, The difference between the driving circuit 850 and the driving circuit 950 is that the driving circuit 950 replaces all of the switches S31, S32, S33, S34, S35, and S36 with n-channel MOSFETs that are labeled S311, S312, S313, S314, S315, and S316 respectively. The voltage sources V31 and V32 have the same voltage potential and are marked as V300. The voltage sources V33 and V34 have the same voltage potential and are marked as V310.

Figure 16:
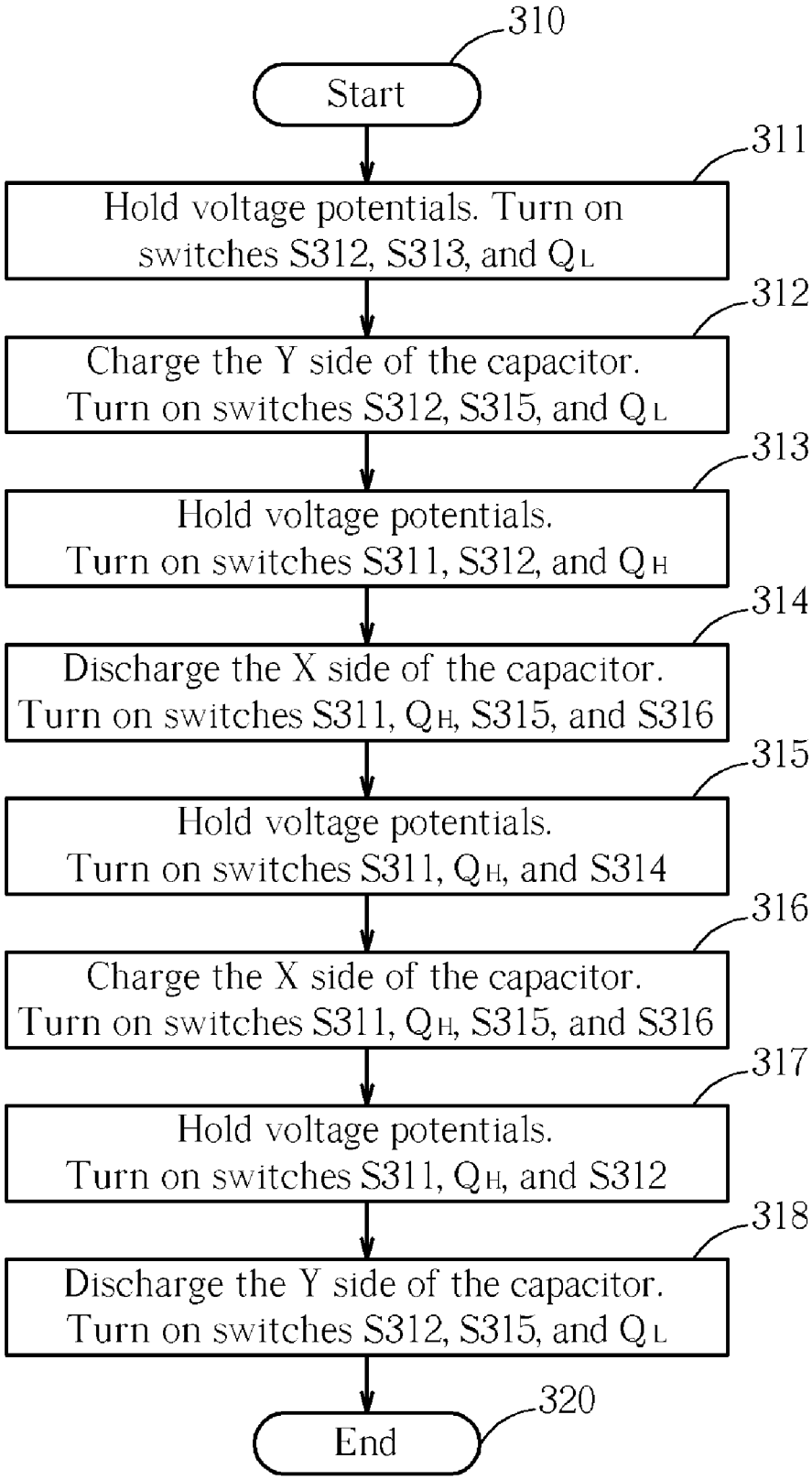
FIG. 16 is a flow chart of creating a sustain waveform in the driving circuit of FIG. 11.

The operation for the sustain waveform is as in the following steps and as shown in FIG. 16. During all steps, switches not indicated as being turning on are assumed to be turned off by default. Obviously, the following steps can be repeated as desired. FIG. 9 would obviously operate similarly with FIG. 11 assuming the appropriate substitution of element number labels.

Step 310: Start.

Step 311: Keep the voltage potential at the X side of the capacitor Cp at V300 by turning on the switch S312. Keep the Y side of the capacitor Cp at V310 by turning on the switches S313 and QL of the Scan IC.

Step 312: Keep the voltage potential at the X side of the capacitor Cp at V300 by turning on the switch S312. Charge the Y side of the capacitor Cp by turning on the switches S315 and QL of the Scan IC. The voltage potential at Y side of the capacitor Cp goes up to V300 through the components S315, QL of the Scan IC and L31.

Step 313: Keep the voltage potential at the X side of the capacitor Cp at V300 by turning on the switch S312. Keep the voltage potential at the Y side of the capacitor Cp at V300 by turning on the switches S311 and QH of the Scan IC.

Step 314: Keep the voltage potential at the Y side of the capacitor Cp at V300 by turning on the switch S311 and QH of the Scan IC. Discharge the X side of the capacitor Cp by turning on the switches S315 and S316. The voltage potential at X side of the capacitor Cp goes down to V310 through the components S315, S316 and L31.

Step 315: Keep the voltage potential at the Y side of the capacitor Cp at V300 by turning on the switch S311 and QH of the Scan IC. Keep the voltage potential at the X side of the capacitor Cp at V310 by turning on the switch S314.

Step 316: Keep the voltage potential at the Y side of the capacitor Cp at V300 by turning on the switch S311 and QH of the Scan IC. Charge the X side of the capacitor Cp by turning on the switches S315 and S316. The voltage potential at X side of the capacitor Cp goes up to V300 through the components S315, S316 and L31.

Step 317: Keep the voltage potential at the Y side of the capacitor Cp at V300 by turning on the switch S311 and QH of the Scan IC. Keep the voltage potential at the X side of the capacitor Cp at V300 by turning on the switch S312.

Step 318: Keep the voltage potential at the X side of the capacitor Cp at V300 by turning on the switch S312. Discharge the Y side of the capacitor Cp by turning on the switches S315 and QL of the Scan IC. The voltage potential at Y side of the capacitor Cp goes down to V310 through the components S315, QL of the Scan IC and L31.

Step 320: End.

Figure 12:
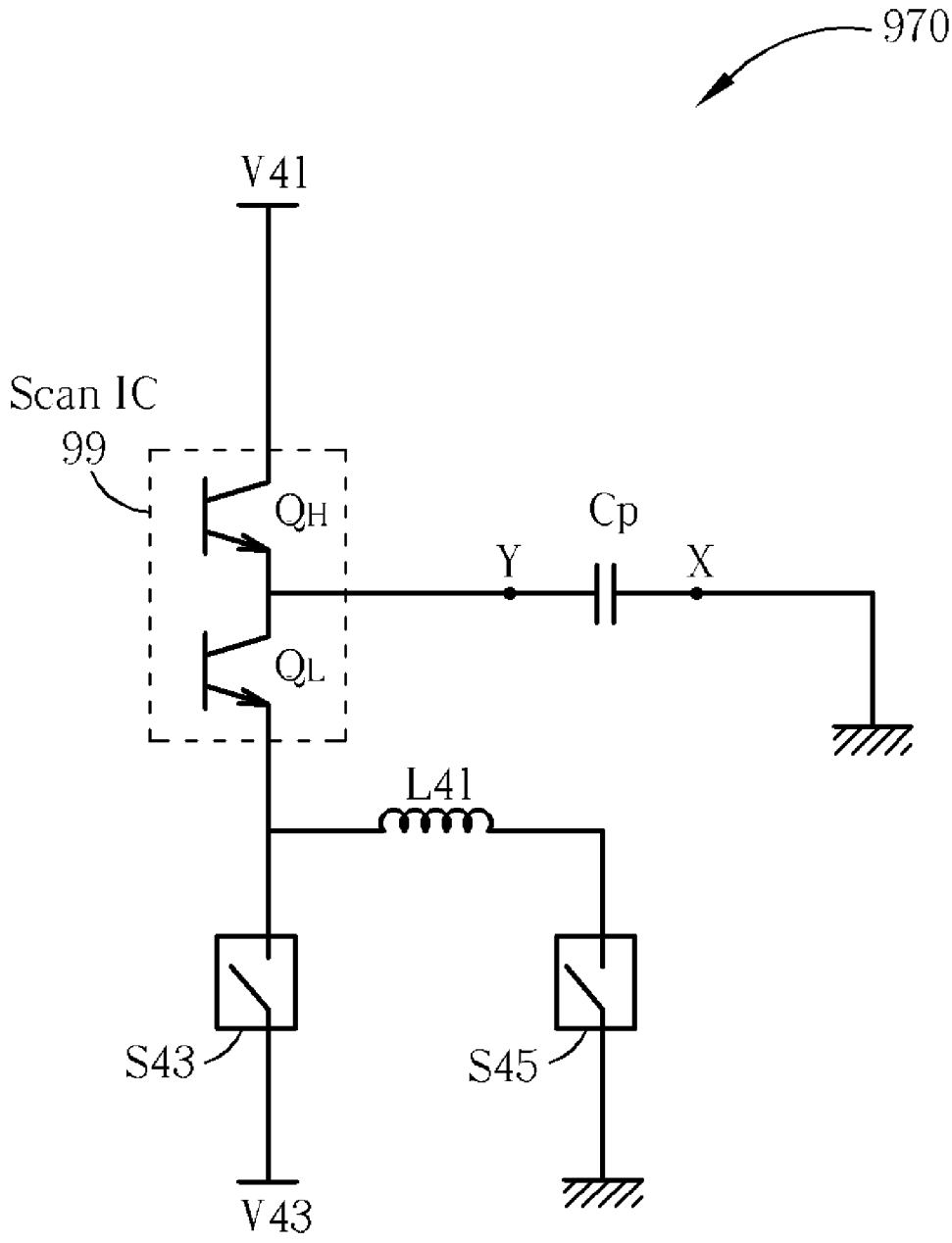
FIG. 12 is another driving circuit for a PDP according to the present invention.

FIG. 12 is another major embodiment of a driving circuit 970 for a PDP according to the present invention that comprises switches S43 and S45, a Scan IC 99, an inductor L41, and a capacitor Cp that is the equivalent capacitor formed by the PDP and having X and Y sides .

On the Y side of the equivalent capacitor Cp, a first voltage source V41 is coupled to a first terminal of the Scan IC 99. The Scan IC 99 comprises a transistor QH coupled between the first terminal of the Scan IC 99 and the Y side and a transistor QL coupled between a second terminal of the Scan IC 99 and the Y side. The switch S43 is coupled between a second voltage source V43 and the second terminal of the Scan IC 99. The second terminal of the Scan IC 99 also couples with the inductor L41, the switch S45, and ground in series. The voltage source V41 is a positive voltage source and V43 is a negative voltage source. The X side of the capacitor Cp couples to directly ground.

Figure 13:
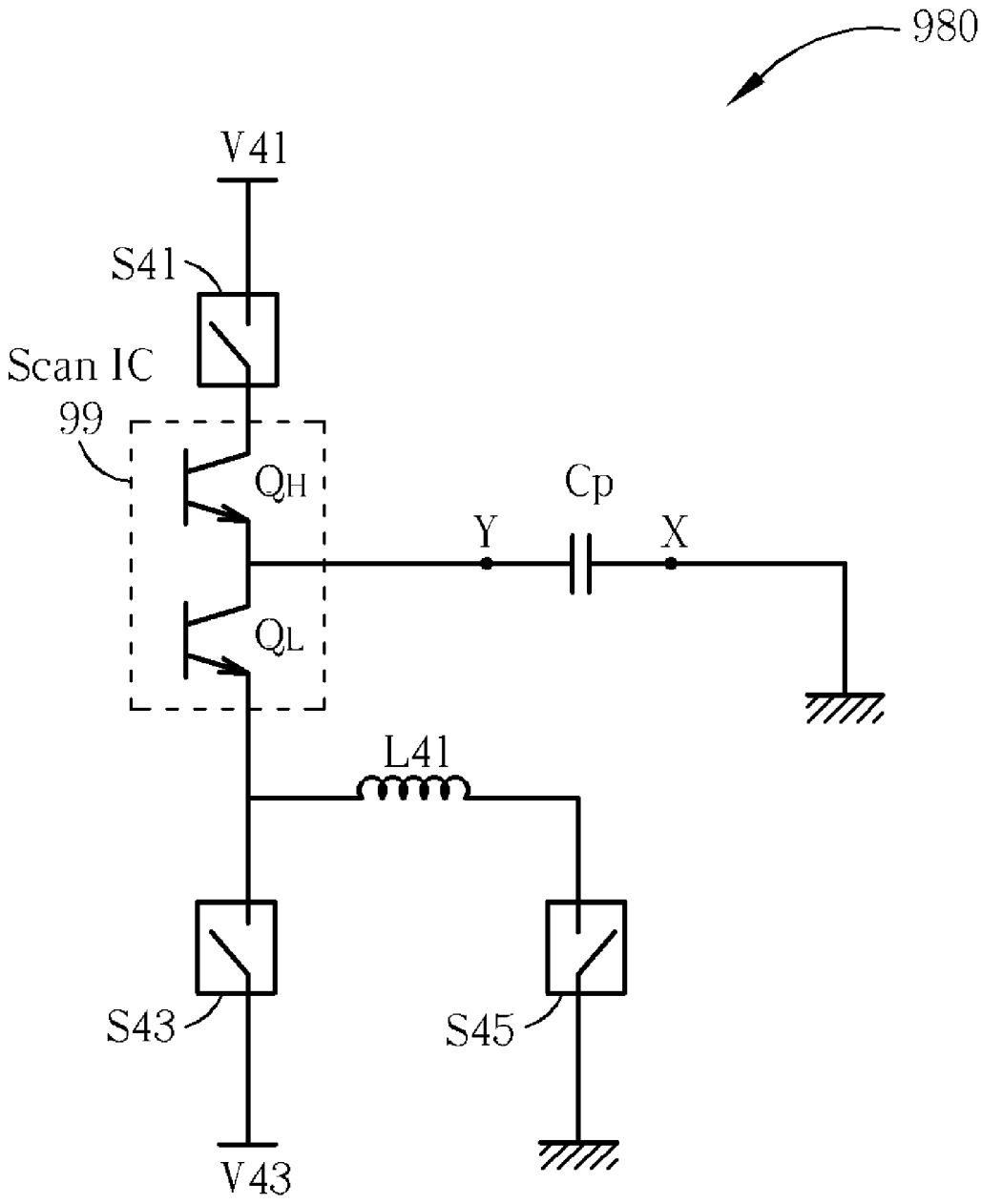
FIG. 13 is one embodiment of the driving circuit of FIG. 12.

FIG. 13 illustrates another PDP driving circuit 980 according to the present invention. All connection and functionalities of like numbered elements in the driving circuit 980 of FIG. 13 are the same as in the driving circuit 970 of FIG. 12. The difference between the driving circuit 980 and the driving circuit 970 is that the driving circuit 980 further comprises a switch S41 coupled between the first voltage source V41 and the first terminal of the Scan IC 99.

Figure 14:
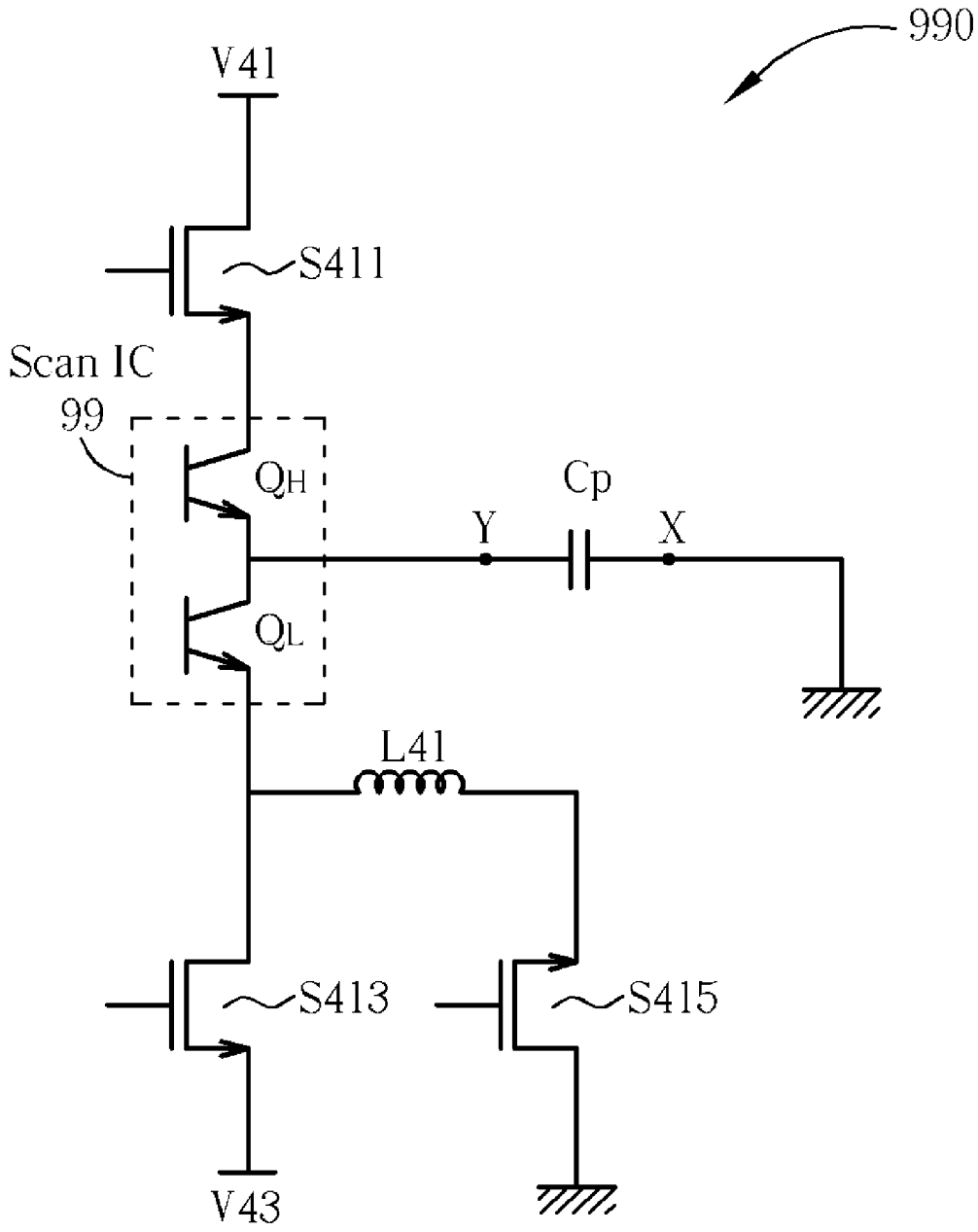
FIG. 14 is an embodiment of the driving circuit of FIG. 13.
Figure 17:
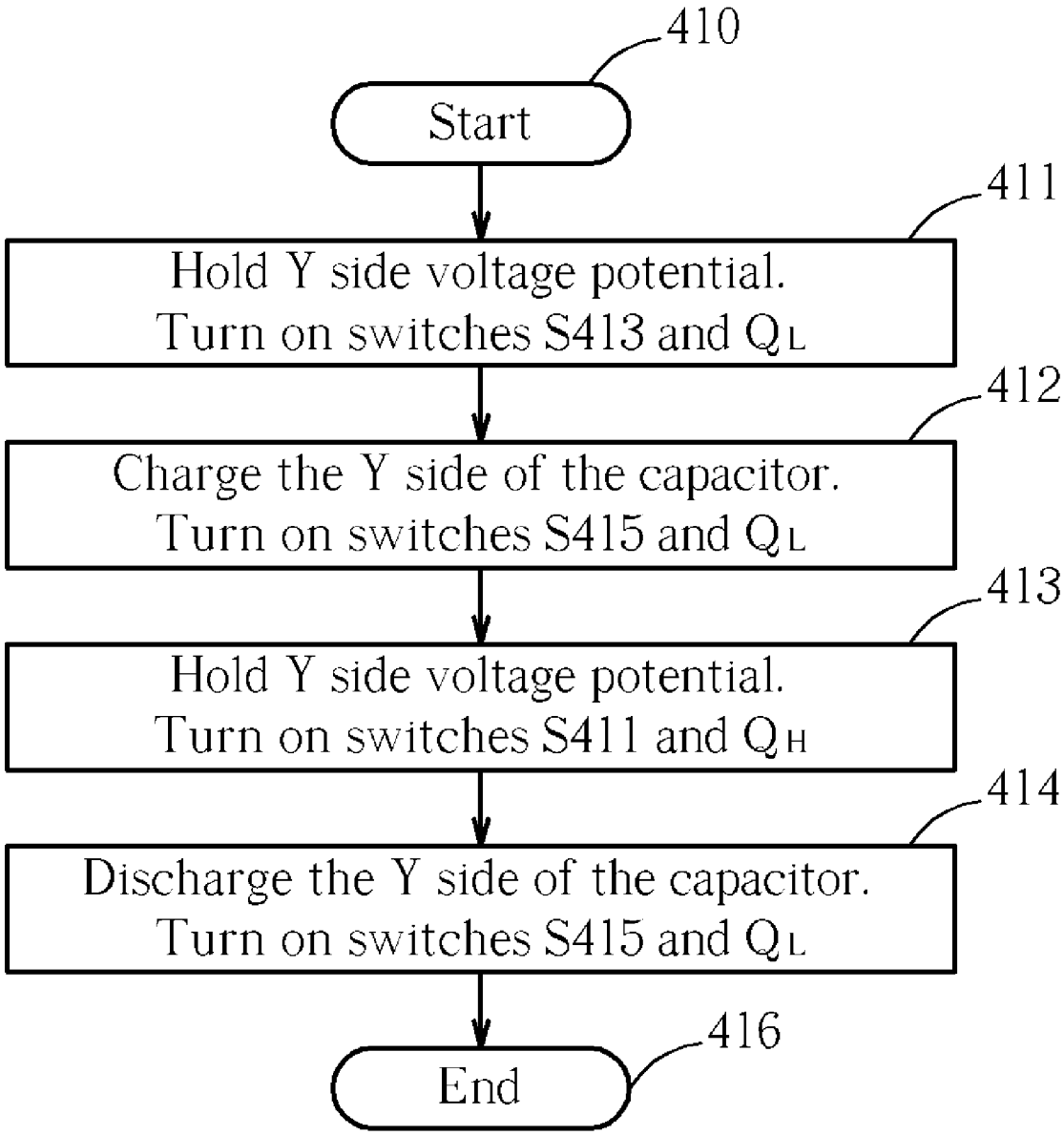
FIG. 17 is a flow chart of creating a sustain waveform in the driving circuit of FIG. 14.

FIG. 14 is a driving circuit 990 that is one embodiment of the driving circuit 980 of FIG. 13 where the switches S41, S43, and S45 in FIG. 13 have been replaced by n-channel MOSFETs S411, S413, and S415 respectively. All other connections and components remain the same. The X side of the capacitor Cp is always coupled to ground. According to the FIG. 14, the operation for a sustain waveform is as shown in the following steps and in FIG. 17. Obviously, the driving circuit 980 of FIG. 13 would function similarly. During all steps, switches not indicated as being turning on are assumed to be turned off by default. The following steps can be repeated as desired.

Step 410: Start.

Step 411: Keep the voltage potential at Y side of the capacitor Cp at V43 by turning on the switches S413 and QL of the Scan IC.

Step 412: Charge the Y side of the capacitor Cp by turning on the switches S415 and QL of the Scan IC. The voltage potential at Y side of the capacitor Cp goes up to V41 through the components S415, QL of the Scan IC and L41.

Step 413: Keep the voltage potential at the Y side of the capacitor Cp at V41 by turning on the switches S411 and QH of the Scan IC.

Step 414: Discharge the Y side of the capacitor Cp by turning on the switches S415 and QL of the Scan IC. The voltage potential at Y side of the capacitor Cp goes down to V43 through the components S415, QL of the Scan IC, and L41.

Step 416: End.

The present invention provides a new driving circuit for a PDP that can generate the necessary driving waveforms at a reduced cost by utilizing fewer components than current related art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit for a plasma display panel, the driving circuit comprising:

an equivalent capacitor having X and Y sides;

a Scan IC comprising a transistor coupled between a first terminal of the Scan IC and the Y side and further comprising a transistor coupled between a second terminal of the Scan IC and the Y side, the first terminal of the Scan IC being coupled with a first voltage source;

a first switch having a first end coupled to the second terminal of the Scan IC, the first end of the first switch also coupled to an inductor, a fifth switch, and ground in series;

a second switch coupled between a second voltage source and the X side;

a third switch coupled with the X side; and a fourth switch coupled between the first end of the first switch and the X side.

2. The driving circuit of claim 1 wherein at least one of the first, second, third, fourth, and fifth switches is a MOS transistor.

3. The driving circuit of claim 1 wherein the first switch and the third switch are each coupled with ground.

4. The driving circuit of claim 3 further comprising a capacitor coupled between the fifth switch and ground.

5. The driving circuit of claim 4 wherein the inductor comprises a first inductor coupled between the fourth switch and the fifth switch and a second inductor coupled between the fifth switch and the second terminal of the Scan IC.

6. The driving circuit of claim 4 further comprising a sixth switch coupled between the first voltage source and the first terminal of the Scan IC.

7. The driving circuit of claim 6 wherein the inductor comprises a first inductor coupled between the fourth switch and the fifth switch and a second inductor coupled between the fifth switch and the second terminal of the Scan IC.

8. The driving circuit of claim 1 wherein the first switch and the third switch are coupled with a third voltage source and a fourth voltage source respectively.

9. The driving circuit of claim 8 wherein the first voltage source and the second voltage source are positive voltage sources and the third voltage source and the fourth voltage source are negative voltage sources.

10. The driving circuit of claim 8 wherein the inductor comprises a first inductor coupled between the fourth switch and the fifth switch and a second inductor coupled between the fifth switch and the second terminal of the Scan IC.

11. The driving circuit of claim 8 further comprising a sixth switch coupled between the first voltage source and the first terminal of the Scan IC.

12. The driving circuit of claim 11 wherein the inductor comprises a first inductor coupled between the fourth switch and the fifth switch and a second inductor coupled between the fifth switch and the second terminal of the Scan IC.

13. The driving circuit of claim 1 wherein the first voltage source and the second voltage source are positive voltage sources.

14. A driving circuit for a plasma display panel, the driving circuit comprising:

an equivalent capacitor having X and Y sides, the X side coupled directly to ground;

a Scan IC comprising a transistor coupled between a first terminal of the Scan IC and the Y side and further comprising another transistor coupled between a second terminal of the Scan IC and the Y side, the first terminal of the Scan IC being coupled with a first voltage source;

a first switch coupled between a second voltage source and the second terminal of the Scan IC; and a second switch coupled to ground and serially coupled with an inductor and the second terminal of the Scan IC.

15. The driving circuit of claim 14 wherein at least one of the first and second switches is a MOS transistor.

16. The driving circuit of claim 14 further comprising a third switch coupled between the first voltage source and the first terminal of the Scan IC.

* * * * *